US011913440B2

(12) United States Patent
Chou et al.

(10) Patent No.: US 11,913,440 B2
(45) Date of Patent: Feb. 27, 2024

(54) FIXING DEVICE OF MOTOR OF AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 13 days.

(21) Appl. No.: 17/739,141

(22) Filed: May 8, 2022

(65) Prior Publication Data

US 2022/0372970 A1 Nov. 24, 2022

(30) Foreign Application Priority Data

May 19, 2021 (TW) ..... 110118139

(51) Int. Cl.
*F04B 39/14* (2006.01)
*F04B 35/04* (2006.01)
*F04B 39/12* (2006.01)

(52) U.S. Cl.
CPC ..... *F04B 39/14* (2013.01); *F04B 35/04* (2013.01); *F04B 39/121* (2013.01)

(58) Field of Classification Search
CPC ..... F04B 35/00; F04B 35/04; F04B 35/06; F04B 39/12; F04B 39/121; F04B 39/14; F04B 53/16; F04B 53/22
USPC ..... 417/415
See application file for complete search history.

(56) References Cited

U.S. PATENT DOCUMENTS 4,306,841 A * 12/1981 Morrison ..... D06F 39/085 68/184
6,095,758 A 8/2000 Chou
2006/0083631 A1* 4/2006 Israelson ..... F02M 37/08 417/423.1
2016/0265522 A1* 9/2016 Chou ..... F04B 39/121

FOREIGN PATENT DOCUMENTS

DE 202019106826 U1 * 2/2020 ..... F04B 35/00
EP 3067559 9/2016
EP 3667084 6/2020

(Continued)

OTHER PUBLICATIONS

"Office Action of Japan Counterpart Application", dated Jun. 6, 2023, p. 1-p. 4.

(Continued)

*Primary Examiner* — Kenneth J Hansen
*Assistant Examiner* — Chirag Jariwala
(74) *Attorney, Agent, or Firm* — JCIPRNET

(57) ABSTRACT

A fixing device of a motor of an air compressor contains: a body, a cylinder, a motor, a transmission mechanism, and at least one retainer. The body includes a first positioning orifice and a second positioning orifice. The cylinder is connected on the body. The motor is fixed on the body, a small gear is received in the first positioning orifice and is connected on the motor, and a connection seat of the motor is accommodated in the first orifice. The transmission mechanism actuates a piston to move in the cylinder reciprocately. The at least one retainer is configured to fix the body and the motor. A first end of at least one retainer is engaged on the body, and a second end of the at least one retainer is engaged on the motor so that the motor is fixed on the body without using any screws.

5 Claims, 7 Drawing Sheets

(56) References Cited

FOREIGN PATENT DOCUMENTS

| | | |
|---|---|---|
| EP | 3670911 | 6/2020 |
| JP | 2006112427 | 4/2006 |
| JP | 3204419 | 6/2016 |
| JP | 3225258 | 2/2020 |
| JP | 3238305 | 7/2022 |

OTHER PUBLICATIONS

"Search Report of Europe Counterpart Application", dated Oct. 25, 2022, p. 1-p. 7.
"Notice of Reasons for Refusal of Japan Counterpart Application", dated Dec. 5, 2023, p. 1-p. 3.

* cited by examiner

FIXING DEVICE OF MOTOR OF AIR COMPRESSOR

FIELD OF THE INVENTION

The present invention relates to a fixing device of a motor of an air compressor which is configured to fix the motor on a body of the air compressor and the air compressor is received in an accommodation box without using any screws.

BACKGROUND OF THE INVENTION

A conventional air compressor contains a body, a cylinder connected on the body, a motor fixed on the body, and a piston driven by the motor to move in the cylinder reciprocately, such that the motor actuates the piston to move in the cylinder reciprocately, thus sucking, compressing, and discharging airs. Furthermore, the air compressor is received in an accommodation box.

The motor is fixed on the body by screws, but it is easy to remove from the body after a period of using time. When the screws are inserted through the body to screw with multiple threaded orifices of a casing of the motor, a tool is difficult to screw the screws with the multiple threaded orifices in a limited space. Therefore, the motor cannot be fixed on the body by using the screws easily.

The present invention has arisen to mitigate and/or obviate the afore-described disadvantages.

SUMMARY OF THE INVENTION

The primary aspect of the present invention is to provide a fixing device of a motor of an air compressor which contains the multiple cavities of the motor configured to engage on the multiple posts of the body, and the at least one retainer is configured to fix the body and the motor, wherein the first end of the at least one retainer is engaged with the body, and the second end of the at least one retainer is engaged on the casing of the motor so that the motor is fixed on the body securely without using any screws.

Another aspect of the present invention is to provide a fixing device of a motor of an air compressor by which the air compressor is received in the accommodation box, and a retaining portion of an inner wall of the accommodation box has a trench configured to limit the at least one retainer between the motor and the body so as to avoid the removal of the at least one retainer from the air compressor.

DETAILED DESCRIPTION OF THE PREFERRED EMBODIMENTS

Figure 7:
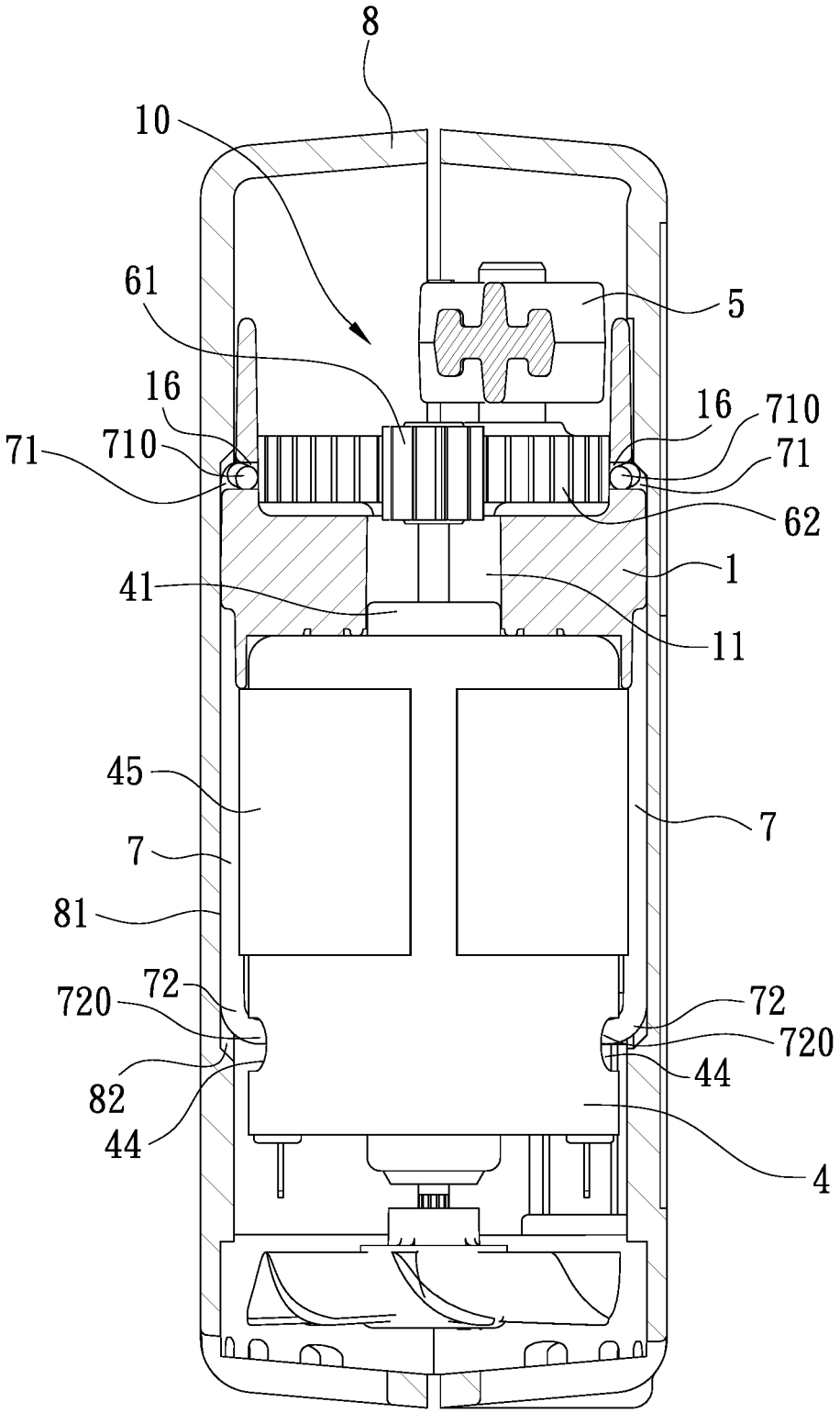
FIG. 7 is a cross sectional view showing the air compressor being received in an accommodation box according to the preferred embodiment of the present invention.

With reference to FIG. 7, an air compressor 10 according to a preferred embodiment of the present invention is received in an accommodation box 8. In this embodiment, as shown in FIGS. 1-4, the air compressor 10 includes a body 1 configured to fix a motor 4, a cylinder 2 connected with the body 1, and a piston 5 driven by the motor 4 to move in the cylinder 2 reciprocately.

The body 1 includes multiple positioning orifices which are a first positioning orifice 11 and a second positioning orifice 12, wherein a small gear 61 is received in the first positioning orifice 11 and is connected on an end of the motor 4, and a connection seat 41 of the motor 4 is accommodated in the first positioning orifice 11. The second positioning orifice 12 is configured to receive a bearing 121. The motor 4 includes a magnetic coil 45 fitted thereon, made of metal material, and configured to conduct magnetism, thus enhancing operation efficiency of the motor 4.

The cylinder 2 is one-piece connected on the body 1 and is in communication with an air storage holder 3, wherein the air storage holder 3 includes at least one tube 30 in which an air hose 31 and a pressure gauge 32 are received.

A transmission mechanism 6 includes a large gear 62 having a counterweight block and configured to mesh with the small gear 61, wherein the large gear 62 is connected with a piston rod 51 of the piston 5 by using an eccentric crank, and the transmission mechanism 6 actuates the piston 5 to move in the cylinder 2 reciprocately so as to produce compressed airs.

Referring to FIGS. 2-5, the fixing device of the motor of the air compressor comprises at least one retainer 7 configured to fix the body 1 and the motor 4, wherein a first end of the at least one retainer 7 is engaged on the body 1, and a second end of the at least one retainer 7 is engaged on a casing of the motor 4 so that the motor 4 is fixed on the body 1 without using any screws.

Figure 1:
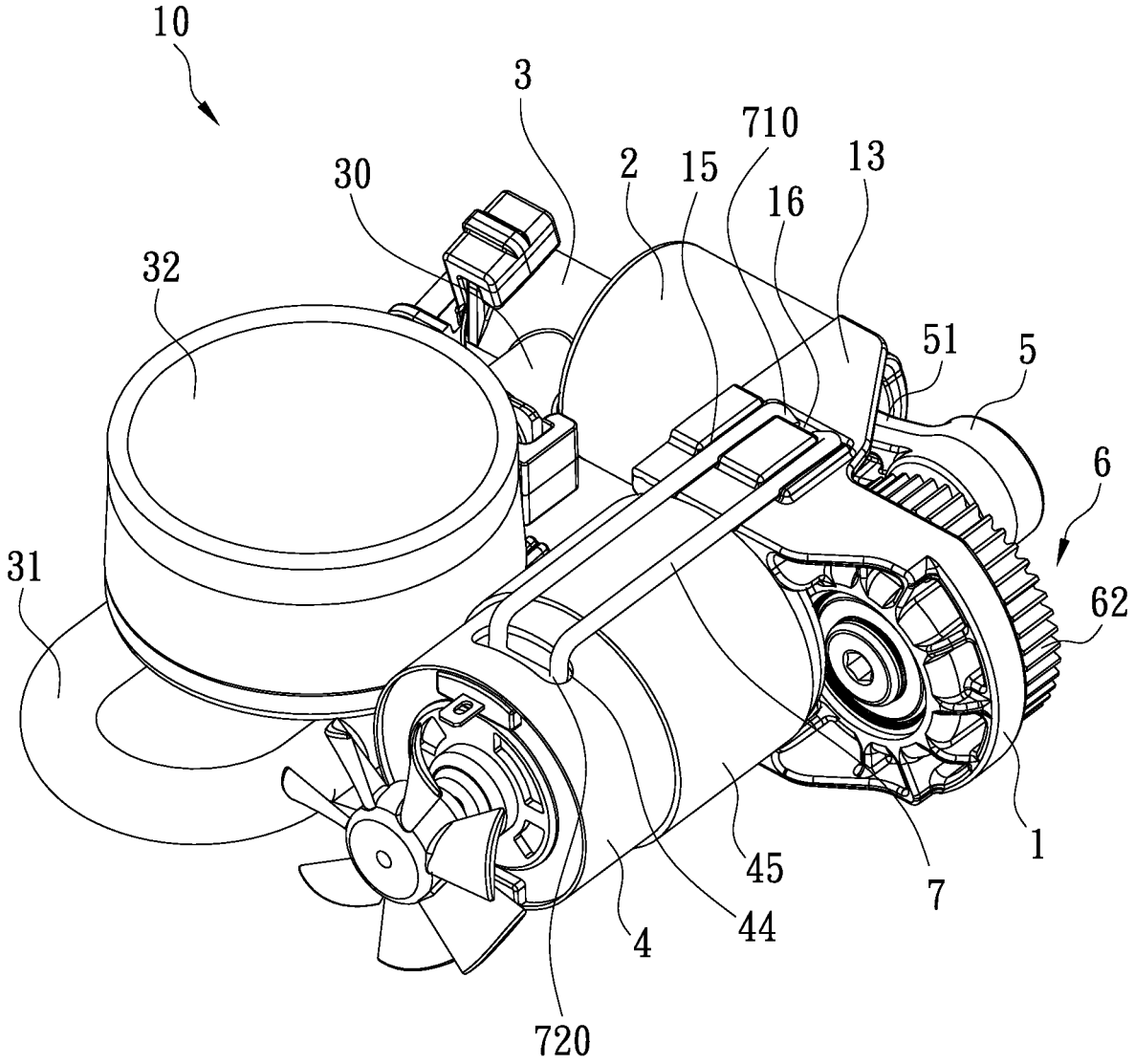
FIG. 1 is a perspective view showing the assembly of a fixing device of a motor of an air compressor according to a preferred embodiment of the present invention.
Figure 2:
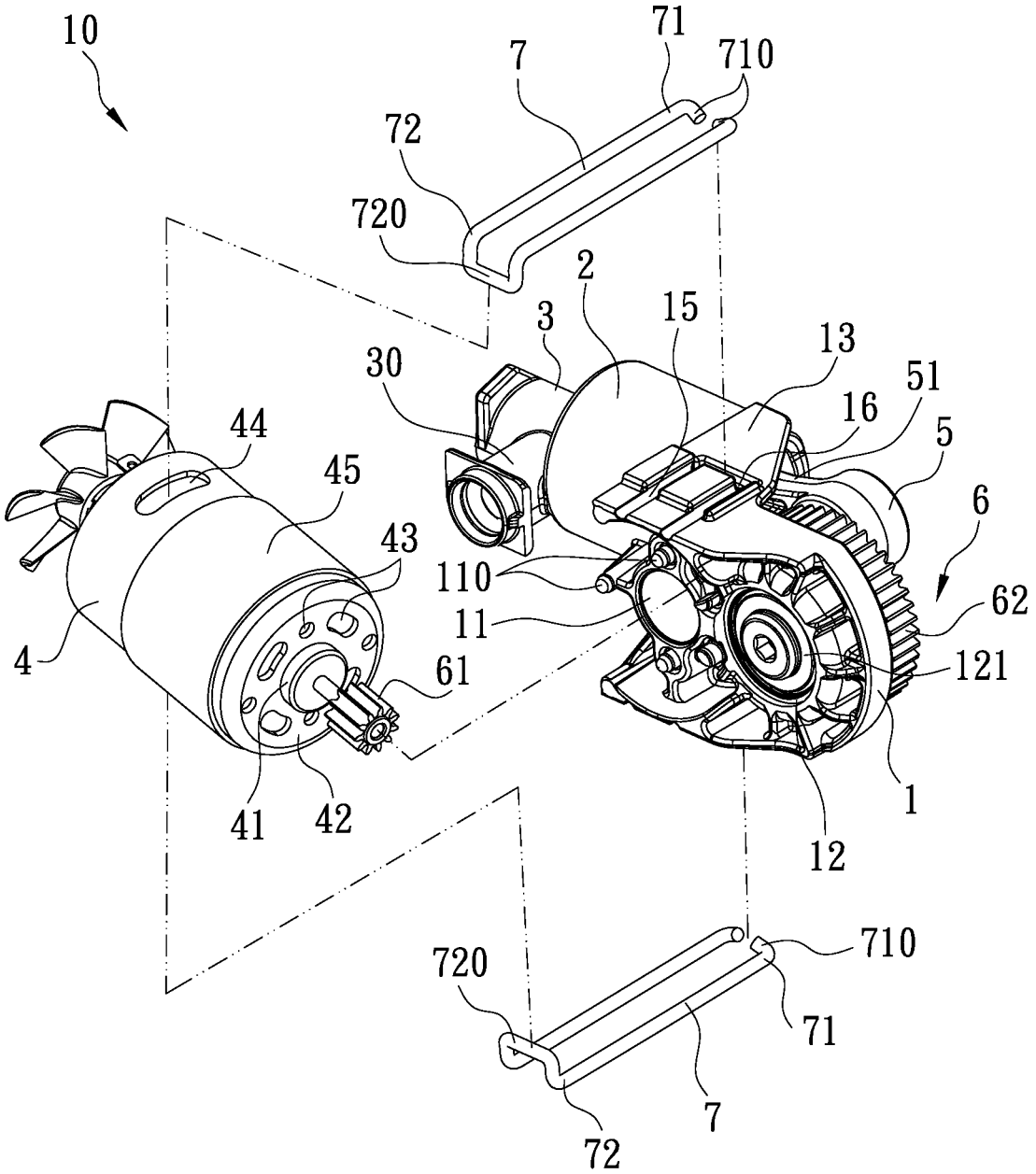
FIG. 2 is a partial perspective view showing the exploded components of the fixing device of the motor of the air compressor according to the preferred embodiment of the present invention.

With reference to FIG. 2, the motor 4 further includes two dissipation holes 44 symmetrically formed on two sides of the casing thereof and configured to circulate airs and to dissipate heat from the motor 4. The motor 4 further includes multiple cavities 43 defined on an edge 42 thereof outside the connection seat 41, and the body 1 includes multiple posts 110 extending outside the first positioning orifice 11 and corresponding to the multiple cavities 43. When fixing the motor 4 on the body 1, the multiple cavities 43 of the edge 42 of the motor 4 are engaged on the multiple posts 110 of the body 1 to fix the motor 4 without using any screws, the connection seat 41 of the edge 42 of the motor 4 is received in the first positioning orifice 11 of the body 1, wherein the first end of the at least one retainer 7 is engaged with at least one third positioning orifice 16 of the body 1, and the second end of the at least one retainer 7 is engaged on the two dissipation holes 44 of the casing of the motor 4 so that the motor 4 is fixed on the body 1 securely without using any screws.

Figure 3:
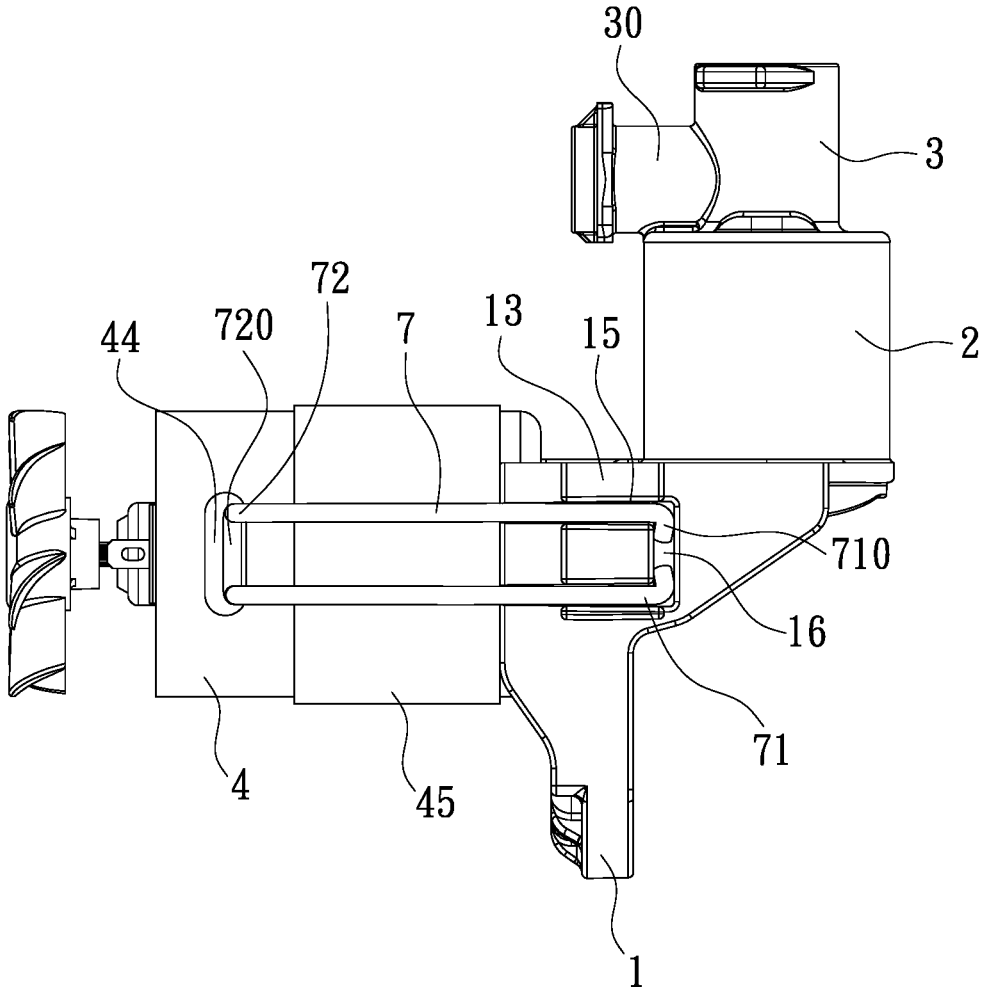
FIG. 3 is a side plan view showing the assembly of the fixing device of the motor of the air compressor according to the preferred embodiment of the present invention.
Figure 4:
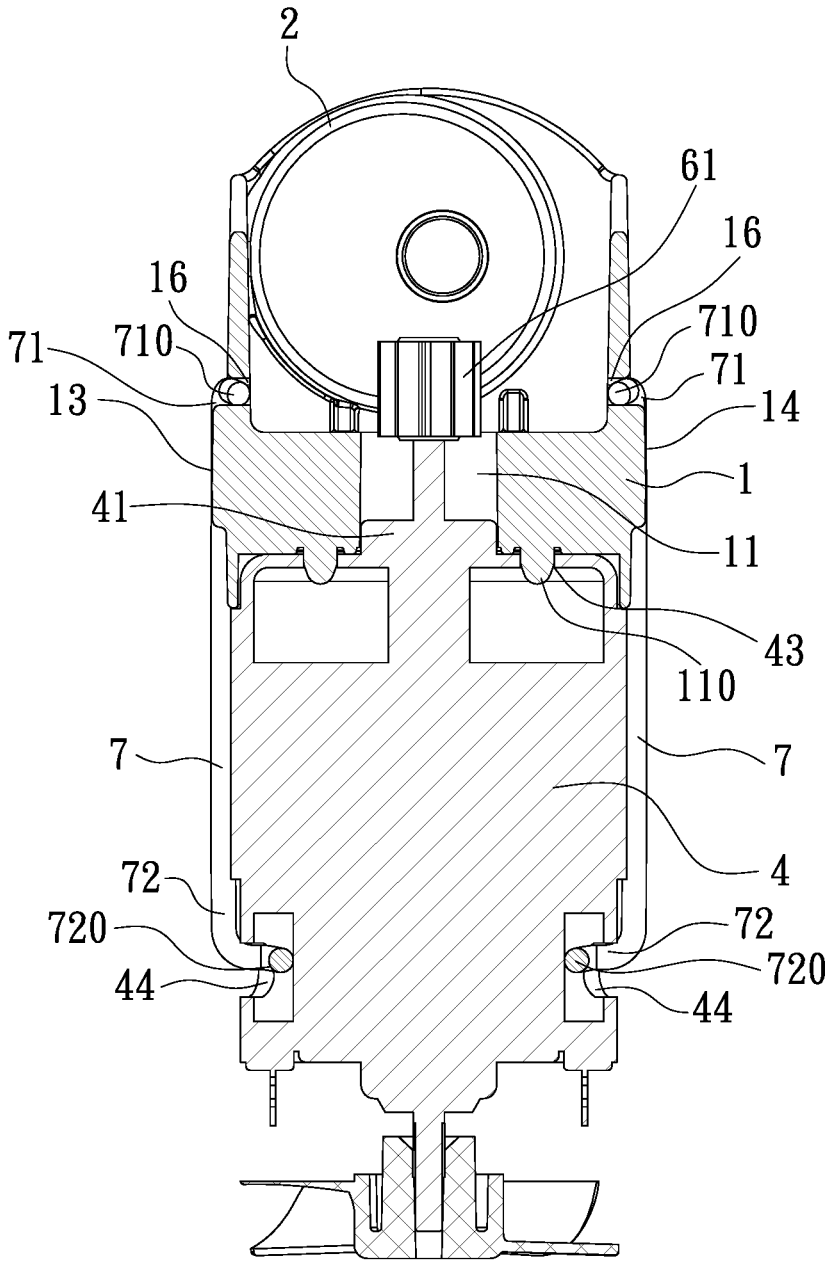
FIG. 4 is a cross sectional view showing the assembly of the fixing device of the motor of the air compressor according to the preferred embodiment of the present invention.
Figure 5:
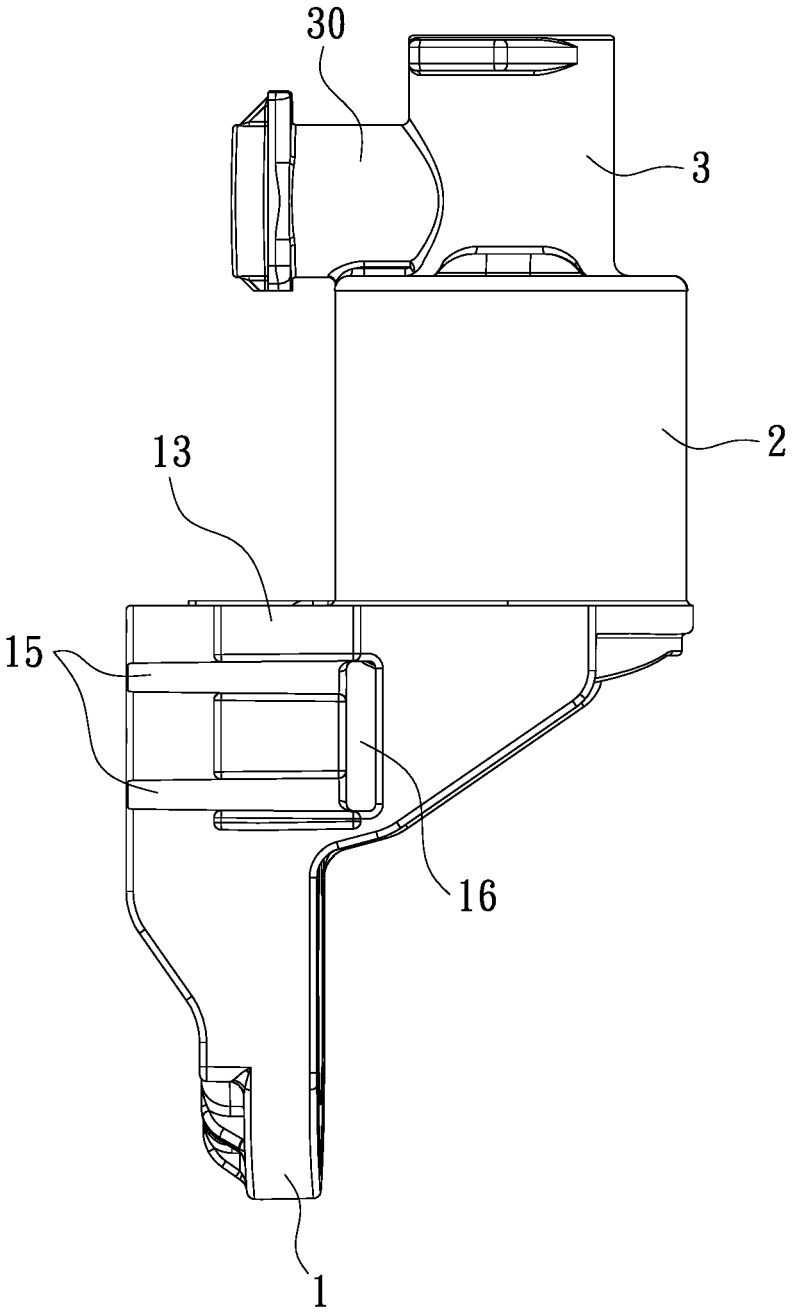
FIG. 5 is a partial side plan view showing the assembly of the fixing device of the motor of the air compressor according to the preferred embodiment of the present invention.

As illustrated in FIG. 2, the first end of the at least one retainer 7 is an open segment 71, and the second end of the at least one retainer 7 is a close segment 72, wherein the open segment 71 of the at least one retainer 7 has a first bent engagement portion 710, and the close segment 72 of the at least one retainer 7 has a second bent engagement portion 720. When the transmission mechanism 6 is connected on the body 1 and the cylinder 2 is connected with an upper portion of the body 1 opposite to the transmission mechanism 6, a first external fence 13 and a second external fence 14 of the body 1 have two receiving grooves 15 and two third positioning orifices 16 which are all defined on the first external fence 13 and the second external fence 14. The at least one retainer 7 is received in the two receiving grooves 15 of the body 1, the first bent engagement portion 710 of the open segment 71 of the at least one retainer 7 is engaged with the two third positioning orifices 16 of the body 1, and the second bent engagement portion 720 of the close segment 72 of the at least one retainer 7 is engaged with the two dissipation holes 44 of the casing of the motor 4, such that the motor 4 is fixed on the body 1 without using any screws, and the at least one retainer 7 is accommodated in the two receiving grooves 15 to avoid a removal from the body 1, as shown in FIG. 3.

Figure 6:
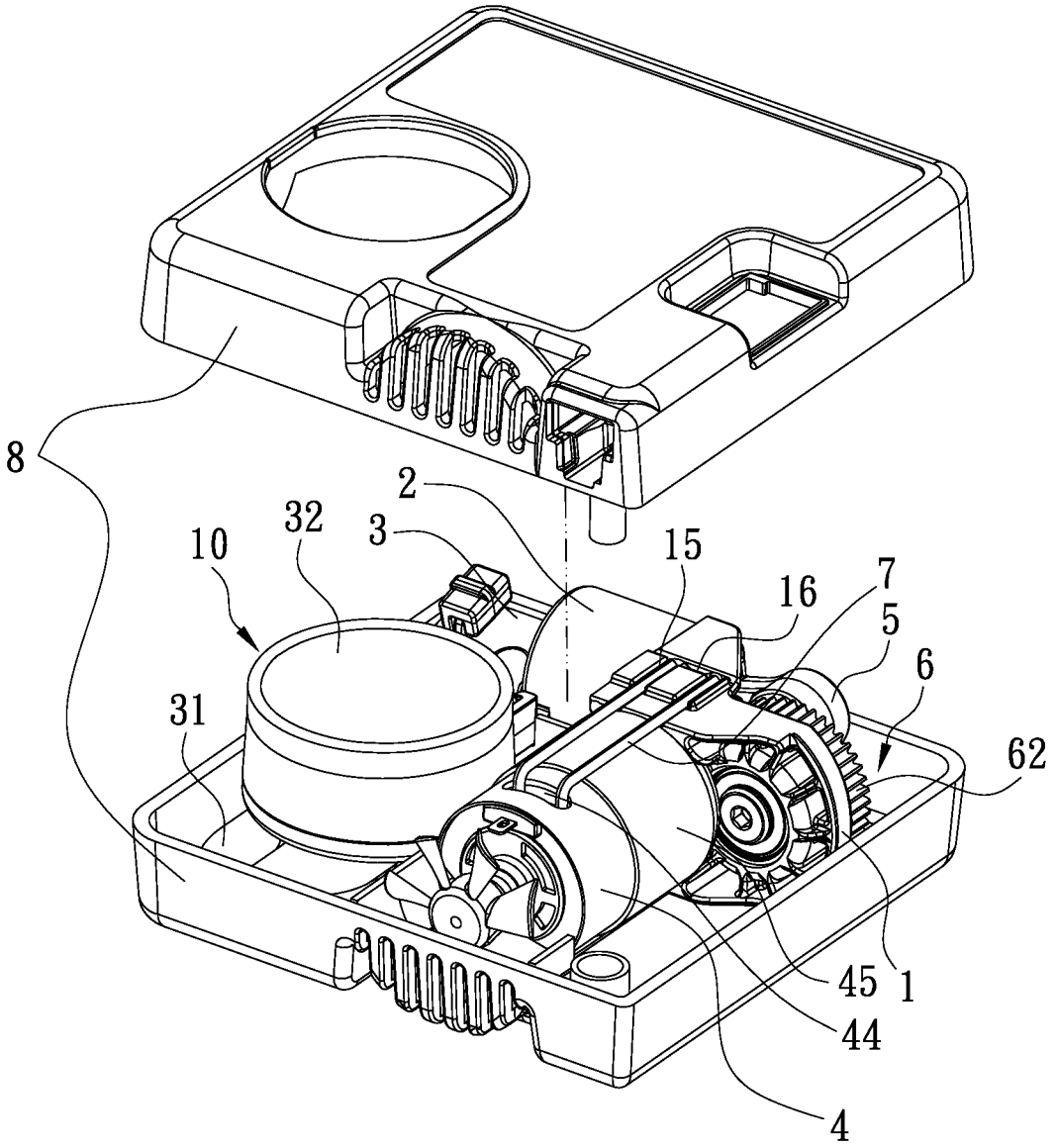
FIG. 6 is a perspective view showing the air compressor being received in an accommodation box according to the preferred embodiment of the present invention.

Referring to FIGS. 6-7, the air compressor 10 is received in the accommodation box 8, and a retaining portion 81 of an inner wall of the accommodation box 8 has a trench 82 configured to limit the at least one retainer 7 between the motor 4 and the body 1 so as to avoid the removal of the at least one retainer 7 from the air compressor 10.

Thereby, the fixing device of the motor 4 of the air compressor 10 contains the multiple cavities 43 of the motor 4 configured to engage on the multiple posts 110 of the body 1, and the at least one retainer 7 is configured to fix the body 1 and the motor 4. For example, the first end of the at least one retainer 7 is engaged with the body 1, and the second end of the at least one retainer 7 is engaged on the casing of the motor 4 so that the motor 4 is fixed on the body 1 securely without using any screws.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A motor driven air compressor with a fixing device, the motor driven air compressor with the fixing device being received in an accommodation box and comprising:

a body includes multiple positioning orifices which are a first positioning orifice and a second positioning orifice;

a cylinder connected on the body and communicating with an air storage holder;

a motor fixed on the body, a first gear being received in the first positioning orifice of the body and being connected on an end of the motor, and a connection seat of the motor being accommodated in the first positioning orifice;

a transmission mechanism actuating a piston to move in the cylinder reciprocately so as to produce compressed air;

wherein at least one retainer is configured to fix the body and the motor, a first end of the at least one retainer is engaged on the body, and a second end of the at least one retainer is engaged on a casing of the motor so that the motor is fixed on the body without using any screws;

wherein the first end of the at least one retainer is an open segment, and the second end of the at least one retainer is a close segment, wherein the open segment of the at least one retainer has a first bent engagement portion, and the close segment of the at least one retainer has a second bent engagement portion, wherein the motor comprises two dissipation holes symmetrically formed on two sides of the casing thereof, wherein each of a first external fence of the body and a second external fence of the body has a receiving groove and a third positioning orifice; the at least one retainer is received in the receiving groove of the body, the first bent engagement portion of the open segment of the at least one retainer is engaged with the third positioning orifice of the body, and the second bent engagement portion of the close segment of the at least one retainer is engaged with the corresponding dissipation hole of the casing of the motor.

2. The motor driven air compressor with the fixing device as claimed in claim 1, wherein the first end of the at least one retainer is engaged on the body, and the second end of the at least one retainer is engaged on the corresponding dissipation hole of the casing of the motor so that the motor is fixed on the body without using any screws.

3. The motor driven air compressor with the fixing device as claimed in claim 1, wherein the motor further includes multiple cavities defined on an edge thereof outside the connection seat, and the body includes multiple posts extending outside the first positioning orifice and corresponding to the multiple cavities; wherein when fixing the motor on the body, the multiple cavities on the edge of the motor are engaged on the multiple posts of the body to fix the motor.

4. The motor driven air compressor with the fixing device as claimed in claim 1, wherein the motor driven air compressor is received in the accommodation box, and a retaining portion of an inner wall of the accommodation box has a trench configured to limit the at least one retainer between the motor and the body so as to avoid a removal of the at least one retainer from the air compressor.

5. The motor driven air compressor with the fixing device as claimed in claim 1, wherein the transmission mechanism is connected on the body and the cylinder is connected with an upper portion of the body opposite to the transmission mechanism.

* * * * *